United States Patent [19]

Vickers et al.

[11] 4,387,043

[45] Jun. 7, 1983

[54] FLUID CATALYST REGENERATION PROCESS AND APPARATUS

[75] Inventors: Anthony G. Vickers, Arlington Heights; Michael J. Humbach, Chicago, both of Ill.

[73] Assignee: UOP Inc., Des Plaines, Ill.

[21] Appl. No.: 288,430

[22] Filed: Jul. 30, 1981

[51] Int. Cl.[3] ..... B01J 21/20; B01J 29/38; C10G 11/18

[52] U.S. Cl. ..... 252/417; 208/164; 422/144

[58] Field of Search ..... 252/417, 419; 208/164, 208/113

[56] References Cited

U.S. PATENT DOCUMENTS

| | | | |
|---|---|---|---|
| 3,843,330 | 10/1974 | Conner et al. | 23/288 B |
| 3,844,973 | 10/1974 | Stine et al. | 252/417 |
| 3,893,812 | 7/1975 | Conner et al. | 23/288 B |
| 3,898,050 | 8/1975 | Strother | 23/288 B |
| 3,919,115 | 11/1975 | Stine et al. | 252/417 |
| 4,118,338 | 10/1978 | Gross et al. | 252/417 |
| 4,197,189 | 4/1980 | Thompson et al. | 208/164 |
| 4,211,636 | 7/1980 | Gross et al. | 208/164 |
| 4,283,273 | 8/1981 | Owen | 252/419 |
| 4,353,812 | 10/1982 | Lomas et al. | 252/417 |

*Primary Examiner*—P. E. Konopka

*Attorney, Agent, or Firm*—James R. Hoatson, Jr.; Louis A. Morris; William H. Page, II

[57] ABSTRACT

A catalyst regeneration process and apparatus for the oxidative removal of coke from a coke-contaminated fluid catalyst. The process utilizes a high temperature coke combustion zone and a catalyst disengagement zone. A mixture of coke-contaminated catalyst, and oxygen-containing gas are contacted in the combustion zone and from there, the regenerated catalyst and flue gas mixture passes to the catalyst disengagement zone. There are one or more diplegs through which regenerated catalyst flows from the disengagement zone to the combustion zone. The diplegs are sized so as to ensure a low maximum accumulation of catalyst in the disengagement zone. The temperature at a lower locus of the combustion zone may be controlled by control of the catalyst inventory in the reactor-regenerator system.

3 Claims, 1 Drawing Figure

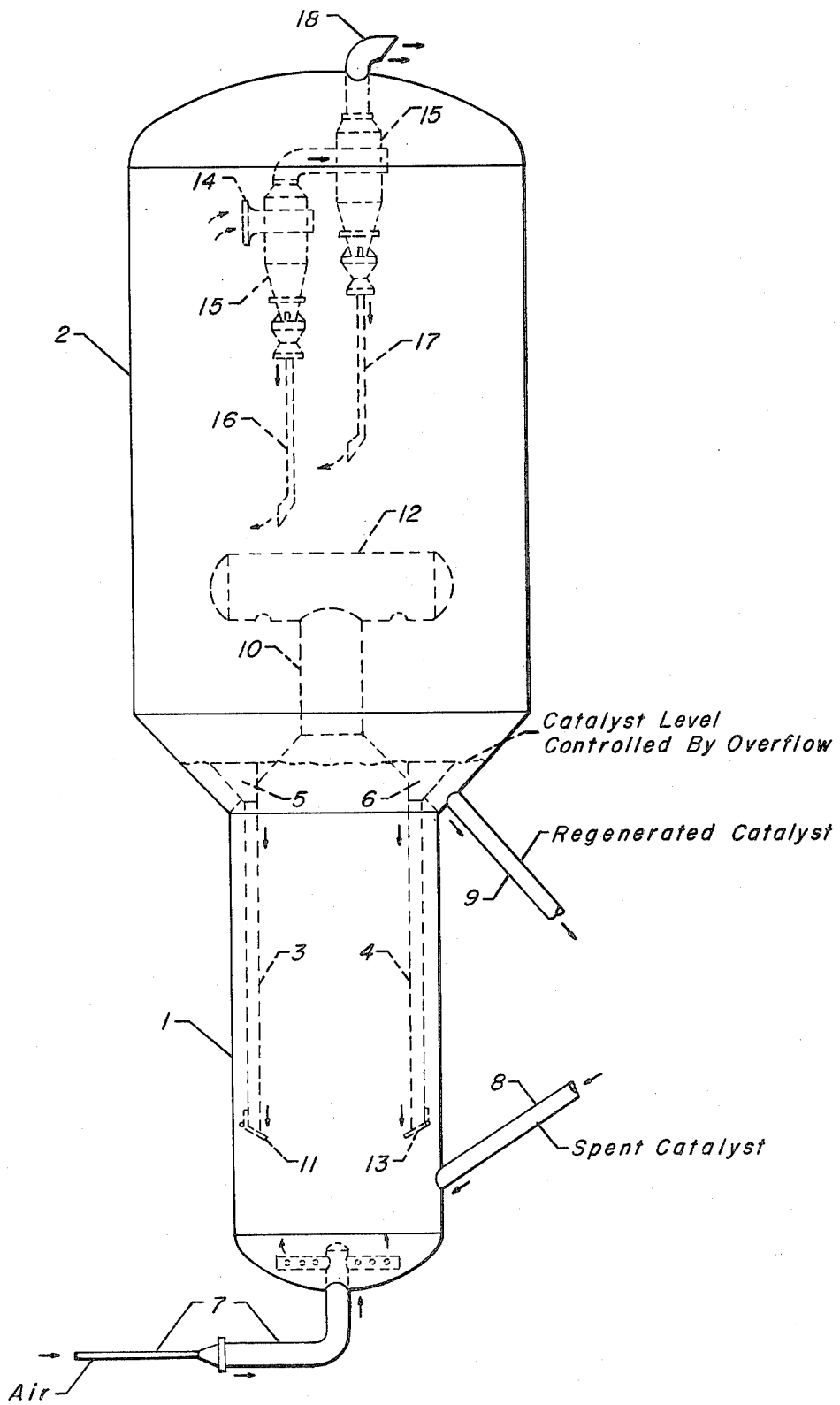
18
15
14
15
2
17
16
12
10
Catalyst Level
Controlled By Overflow
5
6
Regenerated Catalyst
9
3
4
1
8
Spent Catalyst
11
13
7
Air

FLUID CATALYST REGENERATION PROCESS AND APPARATUS

BACKGROUND OF THE INVENTION

The field of art to which this invention pertains is fluid catalyst regeneration. It relates to the rejuvenation of particulated solid, fluidizable catalyst which has been contaminated by the deposition thereupon of coke. The present invention will be most useful in the process for regenerating coke-contaminated fluid cracking catalyst, but it should find use in any process in which coke is burned from a solid, particulated, fluidizable catalyst.

DESCRIPTION OF THE PRIOR ART

The fluid catalytic cracking process (hereinafter FCC) has been extensively relied upon for the conversion of starting materials, such as vacuum gas oils, and other relatively heavy oils, into lighter and more valuable products. FCC involves the contact in a reaction zone of the starting material, whether it be vacuum gas oil or another oil, with a finely divided, or particulated, solid, catalytic material which behaves as a fluid when mixed with a gas or vapor. This material possesses the ability to catalyze the cracking reaction, and in so acting it is surface-deposited with coke, a by-product of the cracking reaction. Coke is comprised of hydrogen, carbon and other material such as sulfur, and it interferes with the catalytic activity of FCC catalysts. Facilities for the removal of coke from FCC catalyst, so-called regeneration facilities or regenerators, are ordinarily provided within an FCC unit. Regenerators contact the coke-contaminated catalyst with an oxygen-containing gas at conditions such that the coke is oxidized and a considerable amount of heat is released. A portion of this heat escapes the regenerator with flue gas, comprised of excess regeneration gas and the gaseous products of coke oxidation, and the balance of the heat leaves the regenerator with the regenerated, or relatively coke-free, catalyst. Regenerators operating at superatmospheric pressures are often fitted with energy-recovery turbines which expand the flue gas as it escapes from the regenerator and recover a portion of the energy liberated in the expansion.

The fluidized catalyst is continuously circulated from the reaction zone to the regeneration zone and then again to the reaction zone. The fluid catalyst, as well as providing catalytic action, acts as a vehicle for the transfer of heat from zone to zone. Catalyst exiting the reaction zone is spoken of as being "spent", that is partially deactivated by the deposition of coke upon the catalyst. Catalyst from which coke has been substantially removed is spoken of as "regenerated catalyst."

The rate of conversion of the feedstock within the reaction zone is controlled by regulation of the temperature, activity of catalyst and quantity of catalyst (i.e. catalyst to oil ratio) therein. The most common method of regulating the temperature is by regulating the rate of circulation of catalyst from the regeneration zone to the reaction zone which simultaneously increases the catalyst/oil ratio. That is to say, if it is desired to increase the conversion rate an increase in the rate of flow of circulating fluid catalyst from the regenerator to the reactor is effected. Inasmuch as the temperature within the regeneration zone under normal operations is invariably higher than the temperature within the reaction zone, this increase in influx of catalyst from the hotter regeneration zone to the cooler reaction zone effects an increase in reaction zone temperature. It is interesting to note that this higher catalyst circulation rate is sustainable by virtue of the system being a closed circuit; and, the higher reactor temperature is sustainable by virtue of the fact that increased reactor temperatures, once effected, produce an increase in the amount of coke being formed in the reaction and deposited upon the catalyst. This increased production of coke, which coke is deposited upon the fluid catalyst within the reactor, provides, upon its oxidation within the regenerator, an increased evolution of heat. It is this increased heat evolved within the regeneration zone which, when conducted with the catalyst to the reaction zone, sustains the higher reactor temperature operation.

The FCC regenerator design currently believed to be the most efficient is one in which combustion of the coke on the catalyst from the reactor (spent catalyst) occurs in a relatively dilute phase combustion zone. Immediately above the combustion zone is a disengagement zone to which the catalyst passes from the combustion zone and in which catalyst separates from flue gas. The catalyst collects at the bottom of the disengagement zone to await withdrawal for return to the reactor. This high efficiency regenerator is known to employ recirculation of regenerated catalyst to the combustion zone in order to control the inlet temperature thereof. Present designs employ external or internal circulating lines usually with control valves to control the rate of catalyst recirculation for the primary purpose of controlling combustion zone temperature. The recirculating catalyst may or may not be cooled. Examples of processes and associated apparatus relating to the high efficiency regenerator are as disclosed in U.S. Pat. Nos. 3,843,330 to Conner et al.; U.S. Pat. No. 3,844,973 to Stine et al.; U.S. Pat. No. 3,893,812 to Conner et al.; U.S. Pat. No. 3,898,050 to Strother; and U.S. Pat. No. 3,919,115 to Stine et al.

Of the above patents, U.S. Pat. No. 3,898,050 to Strother is of particular interest with regard to an internal regenerated catalyst recycle means disclosed therein. This recycle means comprises a dipleg with an outlet in the combustion zone and a series of inlets comprising collecting hoppers at different elevations in the disengaging zone. The rate of catalyst flow down the dipleg is controlled by raising the catalyst level in the disengagement zone, thus causing more of the collecting hoppers to be in communication with the catalyst. The recycle means is not designed to be capable of maintaining a maximum catalyst level in the disengagement zone; i.e. to preclude accumulation of regenerated catalyst inventory in excess of a specific maximum amount, but, to the contrary, requires very substantial amounts of inventory as the controlling variable in regulating catalyst flow down the dipleg, the greater the desired flow the more inventory required.

The present invention enables a high degree of efficiency of operation of an FCC regenerator by utilization of an internal recycle dipleg from the disengagement zone to the combustion zone, but unlike the above prior art FCC processes, the present invention enables the maintaining of a catalyst inventory in the disengagement zone to the least practical amount.

SUMMARY OF THE INVENTION

Accordingly, the present invention is, in one embodiment, a process for regenerating a coke-contaminated fluid catalyst in a fluid catalytic cracking reaction-regeneration unit, the process including the steps of: (a) introducing oxygen-containing regeneration gas and coke-contaminated fluid catalyst, into a lower locus of a dilute phase combustion zone maintained at a temperature sufficient for coke oxidation and therein oxidizing coke to produce regenerated catalyst and flue gas; (b) transporting the flue gas and the regenerated catalyst from an upper locus of the combustion zone into a regenerated catalyst disengaging zone, wherein the regenerated catalyst is separated from the flue gas; (c) transporting a required portion of the regenerated catalyst from the disengaging zone to a reaction zone; (d) recycling substantially all of the remaining portion of the regenerated catalyst from the disengaging zone to the lower locus of the dilute phase combustion zone, and maintaining regenerated catalyst inventory in the disengagement zone to a specific maximum amount.

In a second embodiment, the present invention is an apparatus for regenerating a coke-contaminated, fluid catalyst which apparatus comprises in combination: (a) a vertically oriented combustion chamber; (b) a disengagement chamber located superadjacent to and above the combustion chamber and in communication therewith; (c) a catalyst collection section at the bottom of the disengagement chamber; (d) a regenerated catalyst conduit for removal of regenerated catalyst from the apparatus for use in a reactor; and (e) one or more regenerated catalyst diplegs connecting the bottom catalyst collection section of the disengagement chamber with a lower portion of the combustion chamber, such that regenerated catalyst can flow from the disengagement chamber to the combustion chamber. The inlet of the dipleg is a hopper the lip of which is at the maximum catalyst level desired in the catalyst collection section at the bottom of the disengagement chamber. The desired level is at least as high as above the inlet of the regenerated catalyst conduit, there being a means at the outlet of the dipleg which permits the flow of catalyst only downward through the dipleg. The catalyst diplegs are sized to ensure a combined catalyst flow capacity at least as great as the amount of catalyst likely to accumulate in the disengagement chamber, the diplegs thereby serving as a maximum level control means in the disengagement chamber.

Other embodiments of the present invention encompass further details such as process streams and the function and arrangement of various components of the apparatus, all of which are hereinafter disclosed in the following discussion of each of these facets of the invention.

BRIEF DESCRIPTION OF THE DRAWING

The FIGURE is a sectional, elevation view of a regeneration apparatus according to the present invention, showing combustion zone 1, disengagement zone 2, and regenerated catalyst diplegs 3 and 4.

The above described drawing is intended to be schematically illustrative of the present invention and not be a limitation thereon.

DETAILED DESCRIPTION OF THE INVENTION

The present invention, in its process aspects, consists of steps for the regenerative combustion within a combustion zone of the coke contaminated catalyst from a reaction zone to form flue gas and regenerated catalyst, disengagement and collection of the regenerated catalyst, and recycling substantially all regenerated catalyst to the combustion zone other than that removed for use in the reactor.

Reference will now be made to the attached drawing for discussion of the regeneration process and apparatus of the invention. Regeneration gas, which may be air or another oxygen-containing gas, enters into combustion zone 1 via line 7 and mixes with coke-contaminated catalyst entering in conduit 8. The resultant mixture of coke-contaminated catalyst and regeneration gas is distributed into the interior of combustion zone 1, at a lower locus thereof. Coke-contaminated catalyst commonly contains from about 0.1 to about 5 wt.% carbon, as coke. Coke is predominantly comprised of carbon, however, it can contain from about 5 to about 15 wt.% hydrogen, as well as sulfur and other materials. The regeneration gas and entrained catalyst flows upward from the lower part of combustion zone 1 to the upper part thereof in dilute phase. The term "dilute phase," as used herein, shall mean a catalyst/gas mixture of less than 30 lbs. per cubic foot, and "dense phase" shall mean such mixture equal to or more than 30 lbs. per cubic foot. Dilute phase conditions, that is a catalyst/gas mixture of less than 30 lbs. per cubic foot, and typically 2 to 10 lbs. per cubic foot, are the most efficient for coke oxidation. There will typically be a density gradient in the dilute phase in combustion zone 1, from as high as about 10 lbs. per cubic foot at the bottom to as low as about 2 lbs. per cubic foot at the top. As the catalyst/gas mixture ascends within combustion zone 1 the heat of combustion of coke is liberated and adsorbed by the now relatively carbon-free catalyst, in other words by the regenerated catalyst.

Notwithstanding the above, however, depending on the total catalyst loading of the regeneration gas and on the gas velocity, there may be a dense phase at the bottom of the combustion zone. Under normal design conditions for the FCC combustion zone, this dense phase may extend upwards for up to one-quarter of the combustion zone length. The dense phase region provides mixing of the spent catalyst from the reactor and the catalyst recirculated from the disengaging zone before passing into the dilute phase of the combustion zone, and may therefore be advantageous without compromising the principal advantage of high efficiency coke oxidation that is achieved in the dilute phase combustion zone.

The rising catalyst/gas stream flows through passageway 10 and impinges upon surface 12, which impingement changes the direction of flow of the stream. It is well known in the art that impingement of a fluidized particulate stream upon a surface, causing the stream to turn through some angle, can result in the separation from the stream of a portion of the solid material therein. The impingement of the catalyst/gas stream upon the surface 12 causes almost all of the hot regenerated catalyst flowing from the combustion zone to disengage from the flue gas and fall to the bottom portion of disengagement zone 2. The catalyst collection area of the disengagement zone may be a cone-shaped annular receptacle, as shown, or any other shape appropriate for collecting catalyst particles. The gaseous products of coke oxidation and excess regeneration gas, or flue gas, and the very small uncollected portion of regenerated catalyst flow up through disengagement zone 2 and enters separation means 15 through inlet 14.

These separation means may be cyclone separators, as schematically shown in the FIGURE, or any other effective means for the separation of particulated catalyst from a gas stream. Catalyst separated from the flue gas falls to the bottom of disengagement zone 2 through conduits 16 and 17. The flue gas exits disengagement zone 2 via conduit 18, through which it may proceed to associated energy recovery systems. A first portion of catalyst collected in the disengaging zone is passed to the FCC reactor via conduit 9. The amount of this portion will be whatever rate is required to obtain the desired catalyst to oil ratio in the reactor. There will ordinarily be a slide valve in conduit 9 to control this rate.

Diplegs 3 and 4 serve to circulate regenerated catalyst from disengagement zone 2 to combustion zone 1. The inlets of diplegs 3 and 4 are hoppers 5 and 6 respectively. It is essential that the lips of hoppers 5 and 6 be at the maximum catalyst level desired in the catalyst collection section at the bottom of the disengagement zone 2 which level is at least as high as above the inlet of conduit 9. Thus, it will be ensured that regenerated catalyst will, as a first priority, be returned to the reactor. The amount of catalyst entering disengagement zone 2 in excess of that removed via conduit 9 will accumulate to the level of the lips of hoppers 5 and 6 which are all at the same height and overflow into the hoppers for return to combustion zone 1 and begin to fill the diplegs. There are flapper valves 11 and 13 at the bottom of diplegs 3 and 4 respectively. When the force exerted by the head of the catalyst filling the diplegs on the flapper valves exceeds that pressure required to open the valves, i.e. overcome the force exerted by the springs or counterweights holding the valves closed, catalyst will empty from the diplegs into combustion chamber 1. The flapper valve and/or head of catalyst in the diplegs also serve to prevent undesired reversal of flow up the dipleg.

It is also essential that diplegs 3 and 4 be sized to ensure a combined catalyst flow capacity at least as great as the amount of catalyst that would otherwise tend to accumulate in the disengagement zone, such diplegs thereby serving as a maximum level control means in the disengagement zone. As shown in the FIGURE, the catalyst level (and therefore inventory) is at the very minimum height that will still ensure unlimited access of catalyst to conduit 9 for use in the FCC reactor.

In a preferred mode of steady state operation, the hydrocarbon feed rate, quality and temperature will be fixed and this will result in constant flow rates of air to the combustor via line 7 and a relatively constant flow rate of catalyst to the reactor via line 9. Under these circumstances, the catalyst inventory of the reactor will be relatively constant. As the catalyst inventory of the catalyst disengaging zone is held constant by the unique configuration described above, the catalyst inventory of the combustion zone must also be constant. This means that the recirculation rate of catalyst through the internal circulation lines 3 and 4 is also constant without any means of control such as a catalyst control valve being employed. If under these circumstances it is desired to increase the combustion zone inlet temperature in order to achieve a higher coke oxidation efficiency, this can be done by increasing the overall plant catalyst inventory. As the catalyst inventory of the reactor and catalyst disengagement zone will be unchanged, all of the additional catalyst will end up in the combustion zone and the catalyst recirculated to the combustion zone through the internal circulation lines 3 and 4 will have increased to some new higher value. This will, in turn, result in an increase in the temperature at a lower locus of the combustion zone.

There are inherent advantages to the present invention, particularly with regard to the multiplicity of diplegs and the very low catalyst inventory in the disengagement zone. The multiplicity of diplegs (preferably two or more) enables a more uniform temperature distribution in the combustion zone. The low catalyst inventory in the disengagement zone minimizes the time catalyst will be continuously maintained at a high temperature, i.e. heat soak conditions, and thus minimizes the tendency of the catalyst to deactivate.

What is claimed is:

1. A process for regenerating a coke-contaminated fluid catalyst in a fluid catalyst cracking reaction-regeneration unit, said process including the steps of:

(a) introducing oxygen-containing regeneration gas, and coke-contaminated fluid catalyst, into a lower locus of a dilute phase combustion zone maintained at a temperature sufficient for coke oxidation and therein oxidizing coke to produce regenerated catalyst and flue gas;

(b) transporting said flue gas and said regenerated catalyst from an upper locus of said combustion zone into a regenerated catalyst disengaging zone, wherein said regenerated catalyst is separated from said flue gas and is maintained at a specific maximum quantity of catalyst inventory regardless of the catalyst inventory in said regeneration unit in a dense phase after passage of a portion of said regenerated catalyst to said reaction unit;

(c) transporting a required portion of said regenerated catalyst from said disengaging zone to a reaction zone; and (d) recycling within said regeneration unit via at least one internal recycle dipleg means substantially all of the remaining portion of said regenerated catalyst from said disengaging zone downwardly to said lower locus of said dilute phase combustion zone, and maintaining regenerated catalyst inventory in said disengagement zone to a specific maximum amount regardless of the catalyst inventory in said regeneration unit.

2. The process of claim 1 wherein the temperature at a selected locus of said combustion zone is controllably maintained by controlling the inventory of catalyst in said reaction-regeneration unit and thereby the quantity of regenerated catalyst recycled to said combustion zone.

3. The process of claim 2 wherein said selected locus is a lower locus of said combustion chamber.

* * * * *